US006217168B1

(12) United States Patent
Elgee

(10) Patent No.: US 6,217,168 B1
(45) Date of Patent: Apr. 17, 2001

(54) TRANSPARENCY DETECTION IN A TRAY

(75) Inventor: Steven B Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/256,852

(22) Filed: Feb. 24, 1999

(51) Int. Cl.[7] ..... B41J 2/01
(52) U.S. Cl. ..... 347/105; 347/19; 250/559.4
(58) Field of Search ..... 347/19, 104, 105, 347/106; 250/559.4

(56) References Cited

U.S. PATENT DOCUMENTS 5,139,339 * 8/1992 Courtney et al. ..... 356/446
6,018,164 * 6/2000 Mullens ..... 250/559.4

* cited by examiner

*Primary Examiner*—John Barlow
*Assistant Examiner*—Blaise Mouttet
(74) *Attorney, Agent, or Firm*—Manuel Quiogue

(57) ABSTRACT

A printing system that includes a transparency film detector having a light source for illuminating a sheet of input media and a detector for detecting whether a portion of the light provided by the light source propagated by internal reflection within the volume of the illuminated input media sheet is detected.

13 Claims, 4 Drawing Sheets

TRANSPARENCY DETECTION IN A TRAY

BACKGROUND OF THE INVENTION

The disclosed invention generally relates to hardcopy printing systems, and more particularly to a printing system that optically detects transparency print media.

Printing devices such as ink jet printers apply a printing composition (e.g., ink or toner) to print media in controlled patterns to print text, graphics, images, etc. The print media may be of a variety of different types such as paper, transparency films, special purpose coated paper, fabric, etc. Different types of print media have various characteristics that are ideally accounted for during printing by selection of appropriate printing attributes. Otherwise, a less than optimal printed output may occur, which could be time consuming, costly, and wasteful if print jobs need to be repeated.

One way in which a printing device can be configured to a particular type of print medium is to have a user make adjustments to the printing device based upon the particular print medium. A consideration with this approach is that it requires user intervention, which may be undesirable. Further considerations with this approach are that a user might incorrectly configure the printing device, or a user might not configure the printing device.

One type of print medium that is more costly than standard paper and requires different printing attributes is transparency film. There is accordingly a need for detection of the presence of transparency film in an input tray of a printer.

SUMMARY OF THE INVENTION

The disclosed invention provides a printing system that includes a transparency film detector having a light source for illuminating a sheet of input media and a detector for detecting whether a portion of the light provided by the light source propagated by internal reflection within the volume of the illuminated media sheet is detected.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
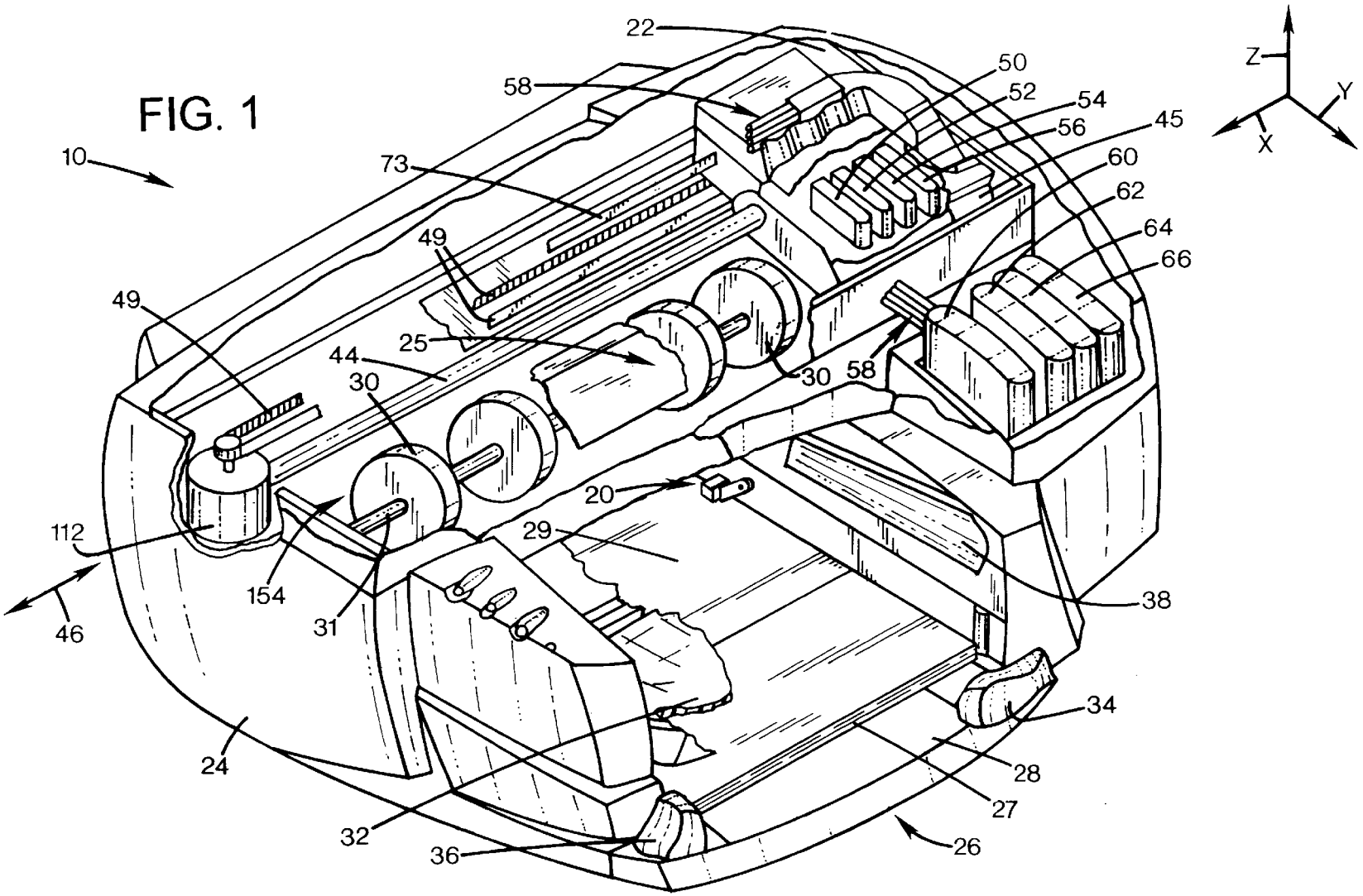
FIG. 1 is a perspective view of an ink jet print printing device incorporating a transparency film detector in accordance with the present invention.

In the following detailed description and in the several figures of the drawing, like elements are identified with like reference numerals.

FIG. 1 sets forth a schematic perspective view of an example of a printing device 10 in which the disclosed invention can be employed. By way of illustrative example, the printing device 10 comprises an ink jet printing device that includes ink jet printheads for applying marks on print media, and in accordance with the invention includes a transparency film detector that detects the presence of a transparency film by sensing whether source illumination propagates internally in a top sheet of print media disposed in a print tray of the printing device. More particularly, the transparency film detector detects whether source illumination provided to the top print media sheet propagates within the illuminated sheet and exits an edge of the print media sheet. If so, the top print media sheet is considered to be a transparency film, and the printing device is configured to use printing attributes appropriate for transparency film.

The ink jet printing device 10 of FIG. 1 more particularly includes a frame or chassis 22 surrounded by a housing, casing or enclosure 24, commonly made of a plastic material. Individual sheets of print media "picked" from a stack 27 of sheets of print media are individually fed through a print zone 25 by a media handling system 26. The print media may be any type of suitable sheet material such as paper, card-stock, transparencies, coated paper, fabric, and the like.

The media handling system includes an input media supply feed tray 28 for storing the stack 27 of sheets of print media before printing. A print media drive roller assembly 154 formed of a plurality of laterally spaced drive wheels or tires 30 co-axially mounted on a common axle 31 and conventionally driven by a stepper motor and drive gear assembly (not shown) may be used to move the print media from the feed tray 28, through the print zone 25, and, after printing, onto a pair of extended output drying wing members 38, shown in a retracted or rest position in FIG. 1. The wing members 38 hold the newly printed sheet for a short time above any previously printed sheets still drying in an output tray 32, and then retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34 and a sliding width adjustment lever 36.

A carriage slider or guide rod 44 is supported by the chassis 22 to slidably support an off-axis ink jet print carriage system 45 for back and forth, or reciprocating, motion across the print zone 25 along a carriage axis 46 which is substantially parallel to the X-axis of an XYZ coordinate system shown in FIG. 1. A carriage scan axis drive motor 112 drives an endless belt 49 that is secured in a conventional manner to the print carriage 45, and a linear encoder strip 73 is utilized to detect position of the print carriage system 45 along the carriage scan axis, for example in accordance with conventional techniques.

In the print zone 25, a media sheet receives ink from an ink jet cartridge, such as a black ink cartridge 50 and three single color ink cartridges 52, 54 and 56 which include respective printheads that selectively eject ink drops to form an image on the media sheet in the print zone 25. By way of illustrative example, the print zone 25 is below the cartridges 50, 52, 54 and 56, and the printheads eject ink drops downwardly. Ink jet cartridges 50, 52, 54, and 56 are also commonly called "pens" by those in the art. In accordance with what is known as an "off-axis" ink delivery system, each of the pens 50, 52, 54 and 56 includes a small on-board reservoir for storing ink that is received from a replaceable main ink reservoir located separately from the pen. In the illustrated printer 10, ink of each color for each printhead is delivered via a conduit or tubing system 58 from a group of replaceable stationary ink reservoirs 60, 62, 64 and 66 to the on-board reservoirs of respective pens 50, 52, 54 and 56.

While the printhead cartridges 50, 52, 54, and 56 are disclosed as printhead cartridges that receive ink from respective remote ink reservoirs 60, 62, 64 and 66, it should be appreciated that the printhead cartridges can comprise self-contained printhead cartridges that have on-board ink reservoirs that are not coupled to remote ink reservoirs.

Each of the printheads of the pens 50, 52, 54 and 56 includes an orifice or nozzle plate having a plurality of ink ejecting nozzles formed therein in a manner well know to those skilled in the art. By way of illustrative example, the printheads of the pens 50, 52, 54 and 56 comprise thermal ink jet printheads. Other types of printheads may also be used, such as piezoelectric printheads.

Figure 2:
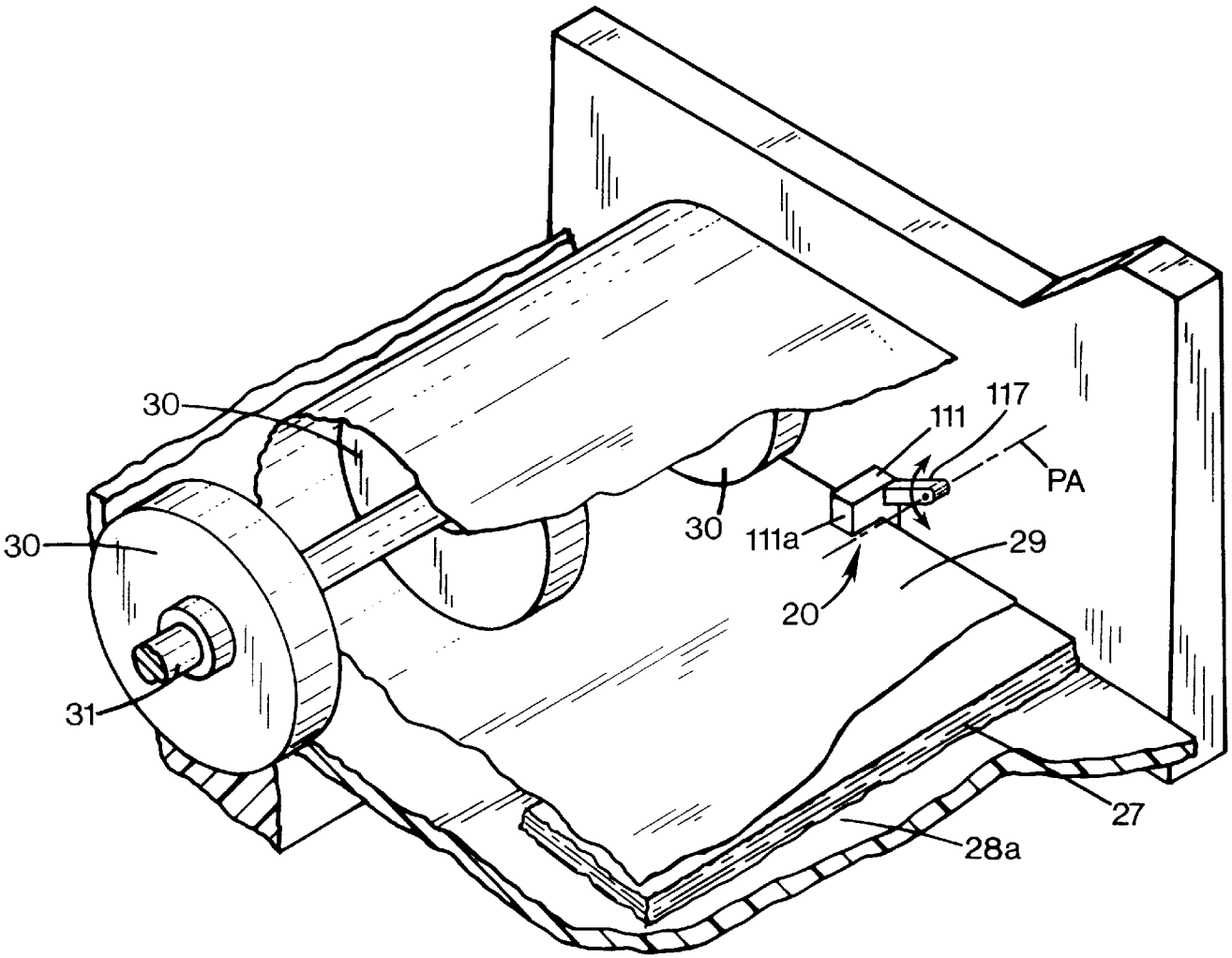
FIG. 2 is a perspective view of a transparency film detector in accordance with the invention.

As more particularly shown in FIG. 2, The printing device 10 of FIG. 1 includes a transparency film detector 20 that spans an edge portion of a top sheet 29 of the media stack 27 and detects whether the top media sheet 29 is a transparency film by sensing whether source illumination propagates by internal reflection in the volume of the top sheet 29.

Figure 3:
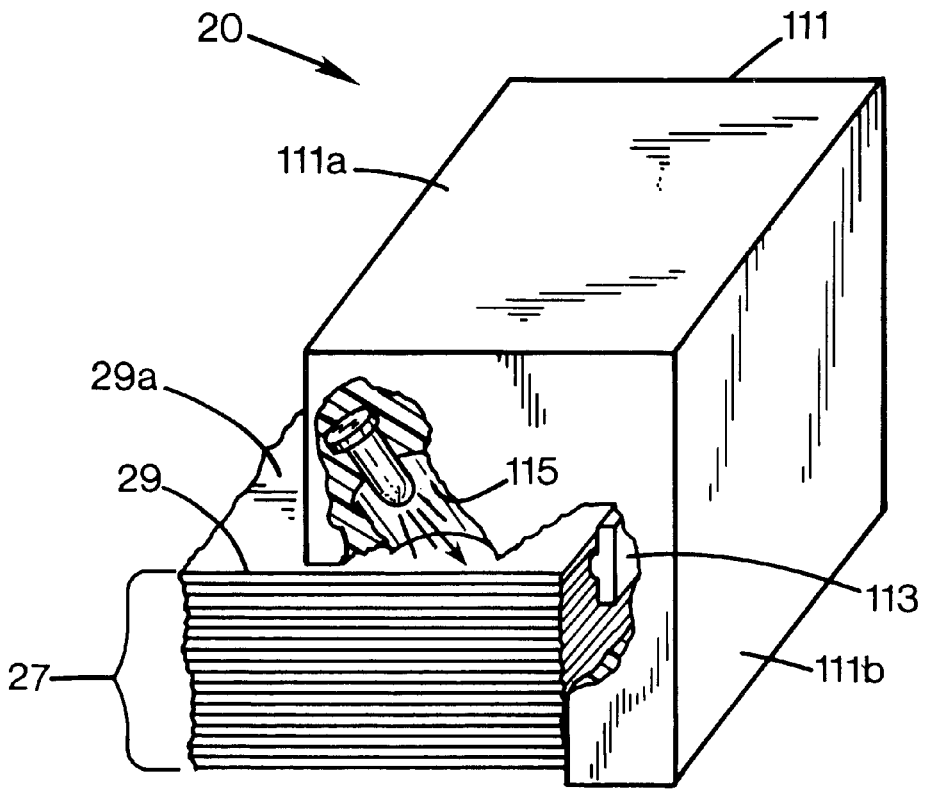
FIG. 3 is a cross-sectional view of the transparency film detector of FIG. 2.
Figure 4:
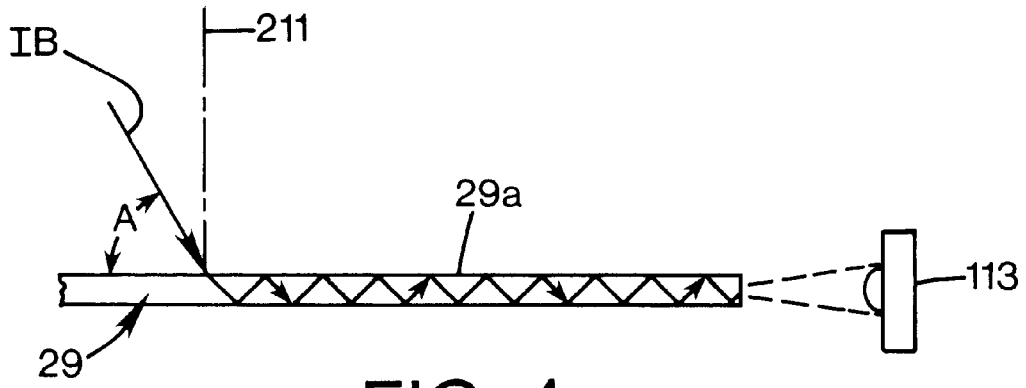
FIG. 4 is a ray diagram illustrating the operation of the transparency film detector of the invention.

Referring now to FIGS. 3 and 4, the transparency film detector 20 more particularly includes a light source 111 that illuminates the top media sheet 29 with an incident beam IB, and an optical detector 113 for intercepting light that exits an edge of the top media sheet 29. The light source 111 is located in a baffle recess 115 in a horizontal portion 111*a* of a housing 111, while the optical detector 113 is in a vertical portion 111*b* of the housing 111 that is outboard of the media stack and adjacent the edge of the top media sheet 29 that is spanned by the transparency film detector. The baffle recess 115 extends to an opening in a bottom surface of the horizontal housing portion 111*a*. The bottom surface of the horizontal housing portion 111*a* rests on the top surface 29*a* of the top sheet 29 of the media stack 27, whereby light from the light source is incident on the top surface 29*a* of the top sheet 29. The baffle recess 115 reduces the amount of light source illumination that would otherwise reach the optical detector by reflection at the top surface 29*a* of the top media sheet 29.

The housing 111 is fixedly attached to one end of a pivot arm 117 (FIG. 2) that is pivotally attached to one side of the input media slot or tray for pivotal rotation about a pivot axis PA that is substantially parallel to the carriage scan axis and is elevationally located such that pivot arm 117 extends downwardly to allow for insertion of media into the media tray 28. The input media tray 28 can include a pressure plate 28*a* that selectively upwardly biases the media stack 27 so that the top sheet 29 of the media stack 27 is at substantially a predetermined elevation for picking, and the housing 111 and the pivot arm 117 are configured so that the bottom surface of the horizontal portion 111*a* of the housing 111 lies generally flat against the top sheet 29 of the media stack 27 when the media stack is upwardly biased for picking.

As shown in FIG. 4, the light source 111 is more particularly configured to illuminate the top surface 29*a* of a top sheet 29 of the print media stored in the media input tray 28 with a substantially collimated or partially collimated incident beam IB at an incidence angle A selected such that if the top print media sheet 29 is a transparency film, a portion of the incident beam would enter the transparency film, propagate by internal reflection within the transparency film, and exit the edge adjacent the detector 113. In other words, the beam angle is selected so that if the top print media sheet 29 is a transparency film, a portion of the incident beam IB is refracted as it passes into the volume of the transparency film and propagates within the volume of the transparency film by a series of internal reflections at the top and bottom surfaces of the transparency film. It is well understood that at appropriate beam angles reflection occurs at the boundary or interface between materials of different indices of refraction, which in this case comprise the interface between the top surface of the transparency film and air, and the interface between the bottom surface of the transparency film and air.

Thus, if a portion of the incident light enters the top media sheet 29, travels in the volume of the top media sheet to the edge thereof, and exits such edge, then the top media will be regarded as a transparency film. Such propagation by internal reflection would not occur a sheet of media that is not film transparency (e.g., paper or cloth).

The light source 111 and the optical detector 113 are oriented such that intersection of the edge of the top media sheet 29 adjacent the detector 113 and the plane of incidence (which contains the centerline of the incident beam and the normal 211 to the top surface 29*a* at the point of incidence, and which is also the plane of FIG. 4) is within the viewing angle of the detector 113.

By way of illustrative example, the light source 111 comprises a light emitting diode (LED) or a laser diode, and the angle of incidence A is optimized for example for the peak wavelength of the LED or laser diode. In other words, the angle of incidence A is selected to optimize the amount of light of the peak wavelength that passes into the volume of a transparency film and propagates or travels therein by internal reflection. Also by way of illustrative example, the detector 113 comprises a photo-transistor.

Figure 5:
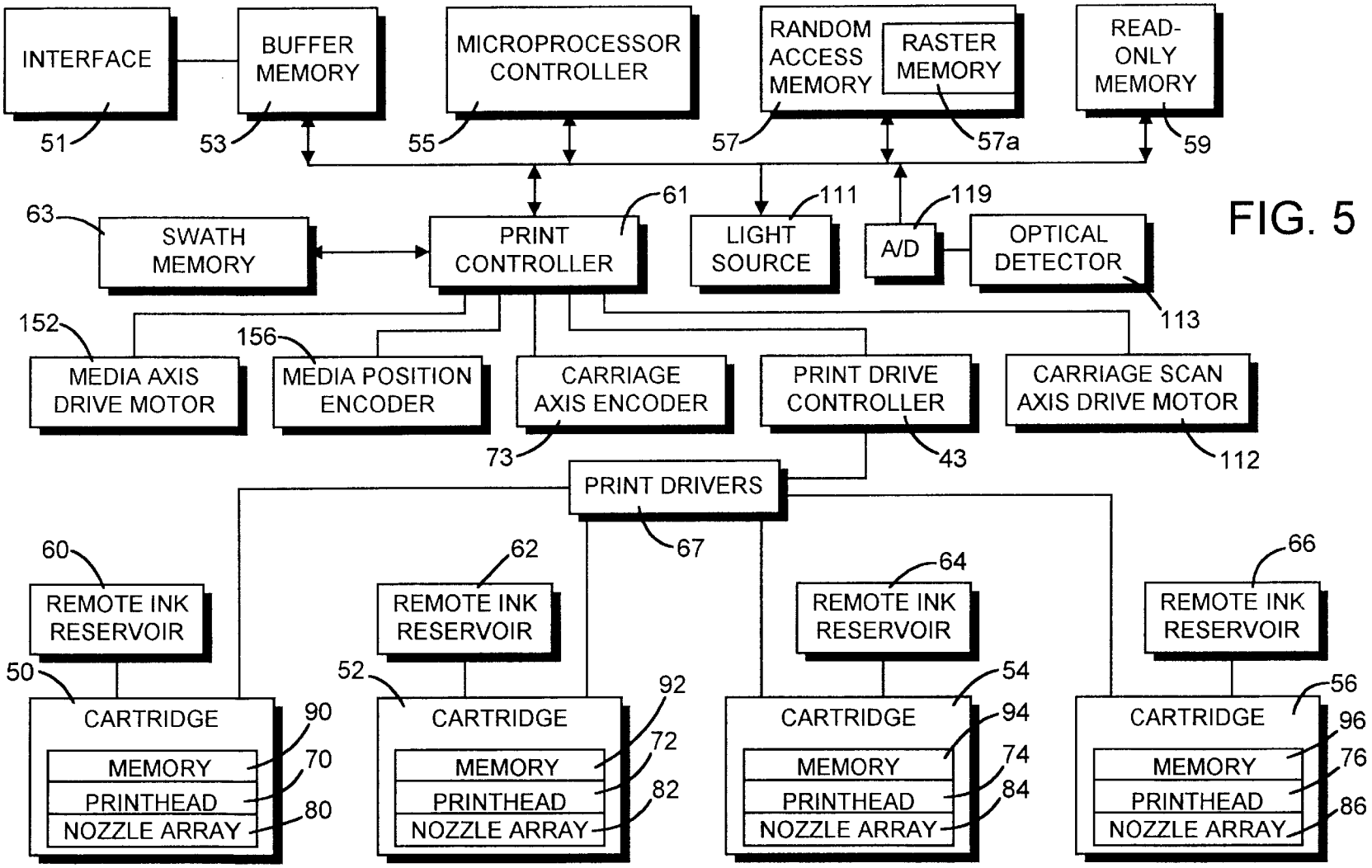
FIG. 5 is a simplified block diagram of a printer controller for controlling the ink jet printing device of FIG. 1.

Referring now to FIG. 5, set forth therein is a simplified block diagram of a control system for controlling the ink jet printer of FIG. 1 in which the techniques of the invention can be implemented. The control system includes an interface 51 which receives print data from a host computer, for example, and stores the print data in a buffer memory 53. A microprocessor controller 55 is configured to process the print data to produce raster data that is stored in a bit-map raster memory 57*a* contained in a random access memory (RAM) 57 provided for the use of the microprocessor controller 55. A read-only memory 59 is also provided as appropriate for the use of the microprocessor controller 55.

A print controller 61 transfers portions of the raster data from the bit-map raster memory 57*a* to a swath memory 63 and provides swath data to a printhead driver controller 43 which controls printhead drivers 67 that drive the ink firing elements of printhead cartridges 50, 52, 54 and 56 that are implemented as single color printhead cartridges and/or as multi-compartment cartridges. The printhead cartridges 50, 52, 54 and 56 include respective printheads 70, 72, 74 and 76 which in turn include respective nozzle arrays 80, 82, 84 and 86 that emit a single color or multiple colors, wherein for example a nozzle array the emits multiple colors is arranged in subarrays that emit ink drops of respective colors.

The printhead cartridges 50, 52, 54 and 56 also include memory elements 90, 92, 94 and 96, for example resistor patterns, each of which contains information about the cartridge such as type, as well as a unique identifier. When a cartridge is installed, the control system reads the information stored in the associated memory element, for example to ensure that the cartridge is of the appropriate type for the particular printer. The control system can also determine whether the newly installed cartridge is a cartridge that had been removed subsequent to an earlier installation.

The print controller 61 further controls a media axis drive motor 152 which moves the print drive roller assembly 154

(FIG. 1) pursuant to media motion commands from the print controller 61. The media position encoder 156 provides information for the feedback control of the media axis drive motor 152. Similarly, the carriage axis encoder 73 provides feedback information for the feedback control of the carriage scan axis drive motor 112 which positions the print carriage 45 (FIG. 1) pursuant to carriage motion commands from the print controller 61.

The microprocessor controller further controls the light source 111, and receives the output an analog-to-digital converter 119 that provides a digital version of the analog output of the optical detector 113. In response to the output of the optical detector 113, the printer employs the printing attributes appropriate for printing on transparency film if transparency film is detected.

Although the foregoing has been a description and illustration of specific embodiments of the invention, various modifications and changes thereto can be made by persons skilled in the art without departing from the scope and spirit of the invention as defined by the following claims.

What is claimed is:

1. A printing system comprising:

marking apparatus for applying marks to a print medium;

a media tray for storing print media including a top print media sheet having a top surface;

a light source for illuminating the top print media sheet with an incident beam at an incidence angle selected such that if the top print media sheet is a transparency film a portion of said incident beam would enter the transparency film and propagate in the transparency film by internal reflection;

a detector for detecting internal reflection of a portion of said beam within the top print media sheet.

2. The printing system of claim 1 wherein said incident beam is partially collimated.

3. The printing system of claim 1 wherein said light source comprises an LED.

4. The printing system of claim 1 wherein said light source comprises a laser diode.

5. The printing system of claim 1 wherein said detector comprises a photo-transistor.

6. The printing system of claim 1 further including a baffle.

7. The printing system of claim 1 wherein said marking apparatus includes dot printing elements.

8. The printing system of claim 1 wherein said marking apparatus includes ink jet printing elements.

9. The printing system of claim 1 wherein said marking apparatus includes a movable ink jet printing carriage.

10. A method of operating a printing device having an input media tray for supporting print media including a top print medium sheet and marking apparatus for making marks on a print medium, the method comprising the steps of:

illuminating the top print medium sheet with an incident beam at an incidence angle selected such that if the top print medium sheet is a transparency film a portion of said incident beam would enter the transparency film and propagate in the transparency film by internal reflection;

detecting whether a portion of the incident beam is propagated by internal reflection within the top print medium sheet; and printing on the top print medium sheet using printing attributes appropriate for a transparency film if a portion of the incident beam propagated by internal reflection within the top print medium sheet is detected.

11. The method of claim 10 wherein the step of printing includes the step of printing dots.

12. The method of claim 10 wherein the step of printing includes the step of ink jet printing.

13. The method of claim 10 wherein the step of printing includes the step of ink jet printing with a scanning print carriage.

* * * * *